United States Patent [19]

Schalk

[11] Patent Number: 5,069,638

[45] Date of Patent: Dec. 3, 1991

[54] CONNECTOR FOR CABLE CONDUCTORS

[75] Inventor: Petrus Wouter H. Schalk, Drunen, Netherlands

[73] Assignee: E. I. Du Pont de Nemours and Company, Wilmington, Del.

[21] Appl. No.: 536,342

[22] Filed: Jun. 11, 1990

[51] Int. Cl.[5] ..... H01R 4/24

[52] U.S. Cl. ..... 439/439

[58] Field of Search ..... 439/436–441

[56] References Cited

U.S. PATENT DOCUMENTS 3,638,171 1/1972 Huibrechtse ..... 439/436
4,410,228 10/1983 Stephenson ..... 439/436
4,647,131 3/1987 Van Woensel .
4,708,417 11/1987 Woertz .
4,713,020 12/1987 Awano et al. .
4,728,295 3/1988 Henrici et al. .
4,767,340 8/1988 Hohorst .

FOREIGN PATENT DOCUMENTS 3311709 10/1983 Fed. Rep. of Germany .
2566967 1/1986 France .

*Primary Examiner*—Joseph H. McGlynn

[57] ABSTRACT

A connector is provided with at least one contact element for making a clamping connection to a conductor of, for example, a cable. The contact element is provided with a spring-loaded and pivotable wall having an edge for acting on the conductor, which edge comprises a boundary edge of an opening or channel in the wall. The other end of the contact element is rigidly connected and fixed to the housing at its base where it acts as a pivot point for the spring-loaded wall of the contact element.

10 Claims, 2 Drawing Sheets

CONNECTOR FOR CABLE CONDUCTORS

FIELD OF THE INVENTION

This invention relates to electric connectors and more particularly to connectors for cable conductors.

DESCRIPTION OF THE PRIOR ART

Cable connectors are generally known in the prior art. There are basically two types of such connectors. A first type, shown in assignee's U.S. Pat. No. 4,713,020 or in French patent specification FR-A-2,566,979 uses a contact element which forms a spring-loaded and pivotable wall, an end of which has an edge which acts on the conductor. With a conductor introduced, the said wall is in contact in its entirely with one side of the conductor. This construction, however, takes up a relatively large amount of space.

Furthermore in the connector according to the French patent specification 2,566,967, the contact element is rigidly connected to the base of the housing. However, this contact element does not cooperate with the housing to provide contact with a conductor to be introduced. The contact element according to the French patent specification is a complicated part comprising several tongues moving relative to each other. A major drawback of this device is that it is very complicated and uses a lot of material.

A second type prior art connector for cable conductors is described in German patent specification DE-A-3,311,709 which describes a connector having a contact element with a pivotable wall wherein the pivot point of the wall is positioned in the direction of introduction of the conductor beyond the point of contact of the conductor and wall. Such connectors are used in applications wherein it is necessary to restrict the clamping force of the pivotable wall to the conductor. This means that if a too large force is exerted on the conductor, it will slip through the opening. This is important to prevent damage to the connector or, if this connector is soldered to a printed circuit board damage, to the circuit board. To release the conductors from the contact element, the housing according to this German patent specification can be moved along a limited path relative to the contact elements. By pushing the housing relative to the contact element, the opening in the pivotable wall will be enlarged to release the conductor. Because of this, the contact elements have to provide the support face between the conductor and a further electric member, such as a printed circuit board. To increase the support face according to this prior art, each contact element is U-shaped near the contact point with the board. Because of the possibility of the movement of the housing relative to the contact elements, it is necessary to take further steps to guarantee contact between the conductor and the contact element. According to the German patent specification, this is realized in that a set of seperate contact lips is provided on the contact element between which the conductor has to be engaged. This further complicates the contact element construction. If the connector has several contact elements, problems can also occur during introduction of a conductor. Because the housing can tilt relative to the contact elements, the openings in the housing might not align with the opening in the contact elements. Furthermore, high localized pressure on the conductor will be directly transferred to the nearest contact element and cause stress concentration on the printed circuit board below. During introduction of the connector with several contact elements into the printed circuit board, problems can also arise because there is no guarantee that the contact elements will all penetrate sufficiently into the printed circuit board during soldering. The same applies if, instead of soldering, a further connector is coupled to this connector. Because of the complicated shape of this prior art connector, it is not possible to produce the housing in one single step. Rather, it becomes necessary to assembly the housing form at least two several parts.

SUMMARY OF THE INVENTION

An object of this invention is to provide a connector having several contact elements which ensures during introduction of the connector into, for example, a printed circuit board or orther connector, guarantees that the contact elements all penetrate to the same extent into the board or other connector. If a localized force is exerted on the housing of the connector it must be equally distributed over the base of the housing, which can have a considerable area so that the underlying printed circuit board or other connector is not harmed. Furthermore, tilting of the housing during introduction of a multi-conductor wire is eliminated.

According to the invention, this and other objects are realized with a connector having at least one contact element of electrically conducting material for the clamping connection of an electrical conductor. The connector comprises a housing having at least on opening for introducing and removing the conductor, near which opening the contact element is situated. The contact element is provided with at least one spring-loaded and pivotable wall having an aperture or opening with an edge for engaging the conductor. This wall is so arranged that, when the conductor is introduced, the wall is capable of pivoting in the direction of freeing the opening and if the conductor moves outwardly, it is capable of exerting a clamping force thereon against a wall of the housing. The pivot point of the wall is positioned in the direction of introduction of the conductor beyond the point of contact of the conductor and the wall. The contact element is rigidly connected to the housing at the base of the housing. Beacause of the fixed relationship of the lower part of the contact element to the housing, its upper part comprising the pivotable wall can provide in cooperation with the fixed wall of the housing sufficient engagement with the conductor to obviate the need for further contact lips to engage the conductor.

According to a preferred embodiment of the invention, the aperture in the pivotable wall is constructed as a slotted cutout. In this way, the use of material for the pivotable wall can be limited as much as possible.

According to a further advantageous embodiment, the contact element comprises a single strip of conducting material of which one extremity provides the pivotable wall and the other extremity provides a connecting pin and is provided with means to engage the housing. Beacause of the simple structure of the contact element, it is possible to make the housing as one part, for example, by injection molding. In the housing, no means are provided in the housing to move the pivotable wall in such a direction that would permit the conductor to be pulled back. This can be realized with means in the wall for moving aside the spring-loaded and pivotable wall to free the opening for a conductor. These means can be either seperate means which can be used for several connectors or cap means constructed to be fitted over the housing of the connector at the end with the opening for receiving the conductor and having at least one corresponding opening and at least one device for displacing the spring-loaded and pivotable wall.

To equally distribute the forces acting on several contact elements provided in the connector, the contact element can be disposed in a staggered arrangement. More contact elements can thereby be arranged within the same area.

DETAILED DESCRIPTION OF THE INVENTION

Figure 1:
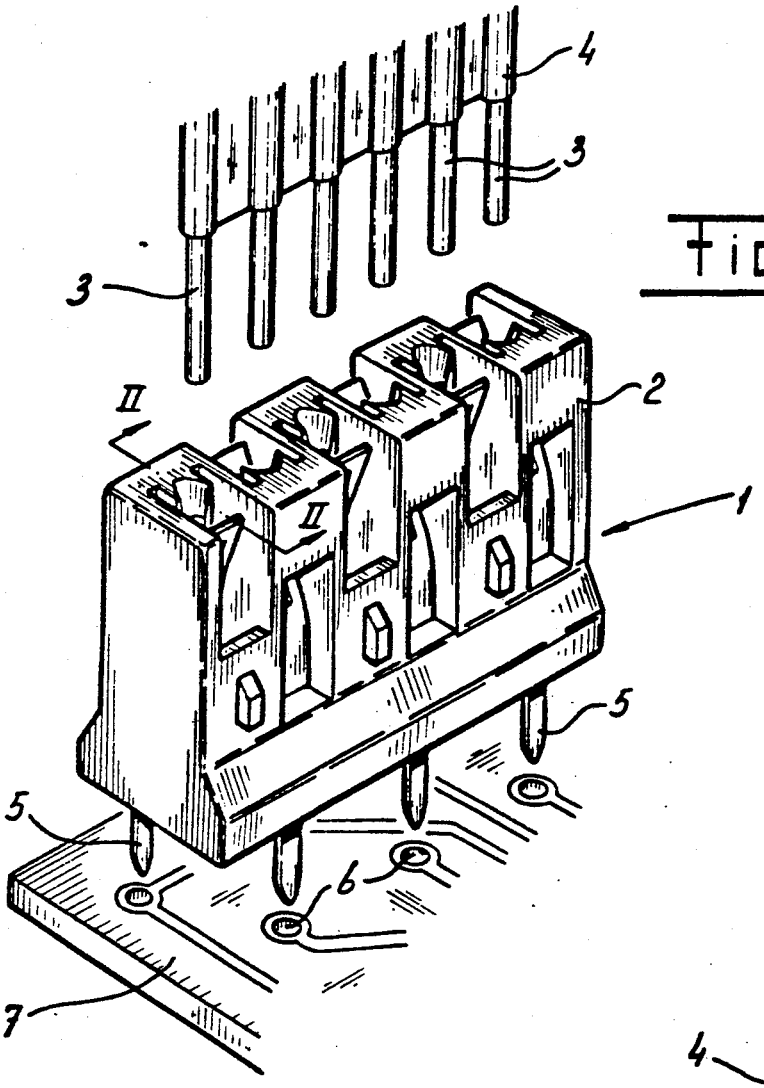
FIG. 1 shows diagrammatically in side elevation a connector according to the invention.

FIG. 1 shows a connector indicated in its entirety by 1. This comprises a connector housing 2 for receiving a row 4 of conductors 3. The connector housing 2 is provided with contact ends 5 to be fitted in openings 6 of an only partially shown printed circuit board 7. As is clear from this figure contact ends 5 are placed in two opposed rows in a staggered arrangement. This allows further miniaturization.

Figure 2:
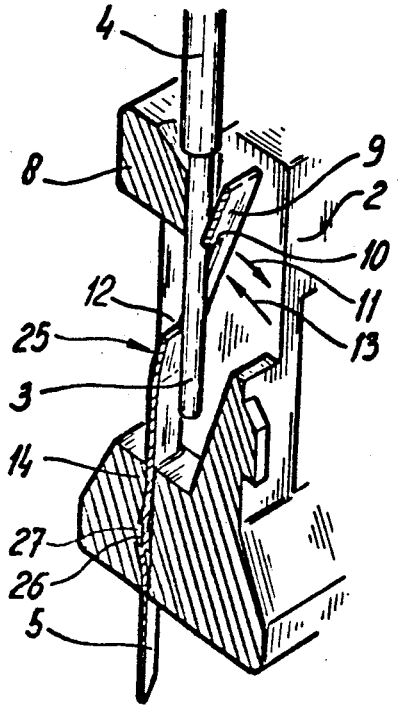
FIG. 2 shows a section along the line II—II in FIG. 1.

FIG. 2 shows the connector housing 2 according to the invention in section. In this, a conductor 3 is fitted in the opening intended therefor. A channel for receiving the conductor 3 comprises a fixed wall 8 and a spring-loaded and pivotable wall 9. The spring-loaded and pivotable wall 9 comprises, in the exemplary embodiment shown here, the extension of the contact end 5 and is provided with an opening 12 or a cutout suitable for the same purpose. Edge 10 of said opening 12 or cutout acts on the conductor 3.

In FIG. 2 it is shown that near contact end 5 contact element 25 is provided with recess 26 to engage a protrusion 27 in the base of housing 8.

The device acts as follows: when the conductor 3 is inserted, the wall 9 moves outwards in the direction of the arrow 11, with the result that the conductor 3 is able to move along the edge 10 through the opening 12 or cutout and arrives in the position shown in FIG. 2. As a result of the spring-loaded action of the spring-loaded and pivotable wall in the direction of arrow 13, the edge 10 is clamped against the conductor 3. If a force is exerted on the conductor 3 in the direction of outward movement of said conductor, the edge 10 will clamp into the material of the conductor 3. It is evident that the pivoting point of the wall 9 is situated near the receiving part 14 of the contact end 5. This is in contrast to the prior art, in which the pivoting point is situated precisely at the other end of the spring-loaded and pivotable wall 9, i.e. at the end where the conductor 3 is introduced into the connector. In the device according to the prior art, this has the result that when a tensile force is exerted on the conductor 3, the clamping force on the spring-loaded and pivotable wall 9 becomes increasingly larger with the risk of damage to, for example, the printed circuit board 7. Because the pivoting point of the spring-loaded and pivotable wall 9 is situated, in the present invention, at the other side of the conductor near the receiving part 14, the clamping force exerted by the edge 10 will have certain limits. These limits are determined in particular, by the frictional force between the different parts and the angle at which the wall 9 acts with its edge 10 on the conductor 3.

Figure 3:
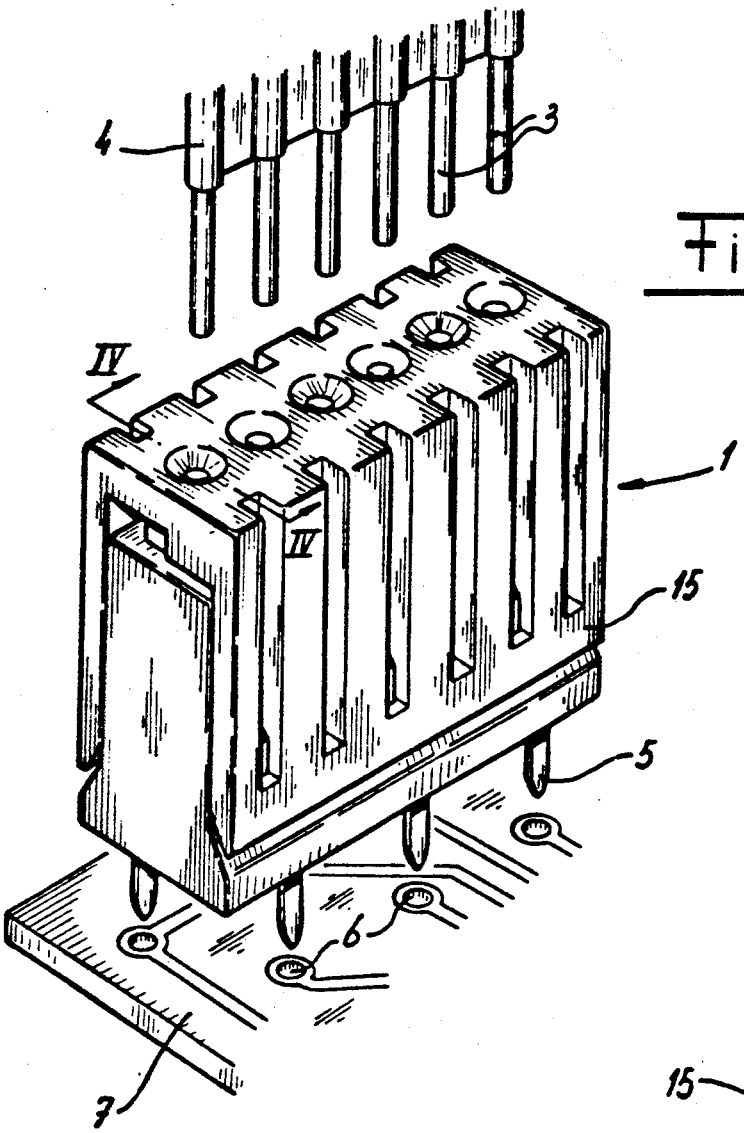
FIG. 3 shows the connector according to FIG. 1 provided with unlocking means diagrammatically in side elevation.
Figure 4:
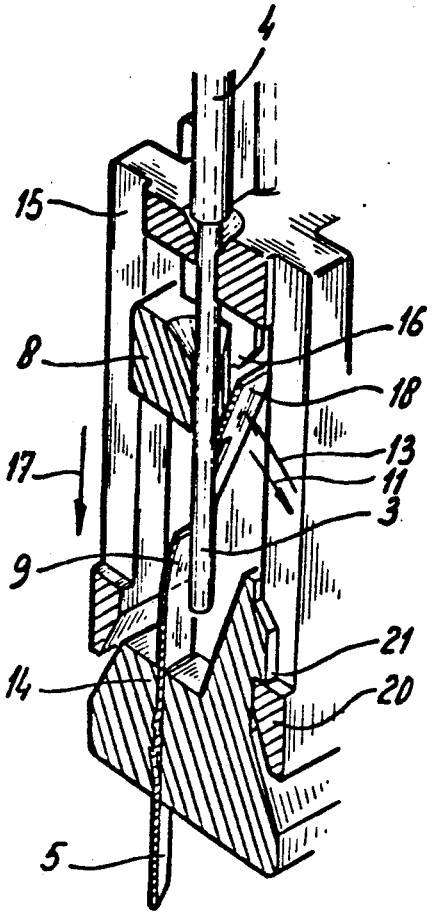
FIG. 4 shows a section along the line IV—IV in FIG. 3.

FIG. 3 shows the connector 1 according to FIGS. 1 and 2 which is provided with unlocking means 15 such as a cap to be fitted over the connector housing 2 and having corresponding openings for introducing conductors 3. The operation of this unlocking means 15 is evident from FIG. 4, a section along the line IV—IV in FIG. 3. When the unlocking means 15 are pressed in, lug 16 acts in the direction of arrow 17 on the end 18 of the spring-loaded and pivotable wall 9 and this is moved outwards in the direction of the arrow 11. Subsequently, the conductor 3 can be introduced unhindered into the channel intended therefor. After the force on the unlocking means 15 is removed, the latter move back upwards, with the result that the conductor 3 is clamped by the movement of the spring-loaded and pivotable wall 9 in the direction of the arrow 13. In order to prevent the un-locking means 15 becoming detached from the connector housing 2, the receiving part 14 and an end part 20 of the unlocking means 15 are provided with snap means 21 which engage in each other. The use of the unlocking means 15 is of importance if it is intended to remove the row 4 of conductors 3 after introduction and if the conductors 3 are composed of a less rigid material, with the result that they are unable to bend the spring-loaded and pivotable wall 9 aside independently.

Although the invention has been elucidated referring to a embodiment being preferred to at the time being, it should be understood that modifications can be made thereto without departing from the scope of the present invention.

I claim:

1. A connector comprising:

a housing of electrically insulating material provided at one side with at least one channel for inserting and withdrawing a conductor of electrically conductive material, said channel having one pivotally movable wall and a second fixed wall, and at least one contact element of electrically conducting material disposed in said housing, one end of said contact element being free and forming said one pivotally movable wall of said channel, a portion of the housing forming said second fixed wall of the channel, the other end of the contact element being fixed in and extending through a second side of the housing, said one end of the contact element being provided with an aperture through which said conductor extends, said conductor passing completely from one end of the aperture to the other, said aperture having an edge at its one end for clamping the conductor at said one end of the contact element which forms said one pivotally movable wall of the channel, said one wall of the channel being spring-loaded and pivotable only about a pivot point near where the other end of the contact element is fixed in said second side of the housing, said conductor being clamped by said edge so as to be pressed between said movable one wall and fixed second wall of said channel while remaining substantially free while passing through said aperture, whereby insertion of the conductor into the channel causes said one movable wall to pivot away from said second fixed wall and open the channel to permit the conductor to enter and pass through the channel into the housing while preventing the conductor from being withdrawn due to the clamping action on the conductor by the edge of the aperture in said pivotable one wall, said aperture also permitting the pivotable wall of the contact element to contact both sides of the conductor.

2. The connector of claim 1 wherein the aperture in said contact is formed as a slotted cutout.

3. The connector of claim 1 wherein said housing has a plurality of channels and a plurality of corresponding contact elements intend to receive a plurality of conductors of a cable.

4. A connector according to claim 1 wherein said housing is provided with a plurality of channels, each for insertion and withdrawal of a separate conductor, and wherein a plurality of contact elements are disposed in said housing, said one end of each said contact element forming one wall of a respective channel and a portion of said housing forming said second wall of each said channel, said plurality of contact elements being disposed in a staggered arrangement within the housing.

5. The connector of claim 1 wherein said pivotable one wall at said one end of the contact element comprises a contact end and said other end extending from a second side of the housing comprises a connecting end.

6. The connector of claim 5 wherein the connecting end of the contact element is a connecting pin adapted for insertion into a hole of a printed circuit board.

7. The connector of claim 1 further comprising unlocking means for pivoting said one wall to increase the size of the channel to permit insertion or withdrawal of the conductor.

8. The connector of claim 7 wherein said unlocking means comprise a cap-like member adapted to fit over said one side of the housing and having an opening corresponding to each channel in the housing.

9. The connector of claim 8 wherein said cap-like member further including a lug projection which engages and pivots said one wall to increase the size of said channel.

10. The connector of claim 8 wherein said cap-like member having a surface adapted to snap around another surface in said housing to prevent detachment.

* * * * *